United States Patent [19]

Hsie

[11] Patent Number: 4,521,529

[45] Date of Patent: Jun. 4, 1985

[54] CATALYST FOR CRACKING KEROSENE

[75] Inventor: C. H. Hsie, Fong Shan, Taiwan

[73] Assignee: Son Su Kung, Fong Shan, Taiwan

[21] Appl. No.: 646,858

[22] Filed: Sep. 4, 1984

[51] Int. Cl.[3] ..... B01J 27/02; B01J 29/00; B01J 29/06; B01J 23/62

[52] U.S. Cl. ..... 502/217; 502/218; 502/241; 502/242; 502/244; 502/251; 502/253; 208/113; 208/119; 208/120

[58] Field of Search ..... 502/217, 218, 241, 242, 502/244, 251, 253

[56] References Cited

U.S. PATENT DOCUMENTS

| | | | |
|---|---|---|---|
| 2,402,958 | 7/1946 | Globus | 502/217 X |
| 3,216,954 | 11/1965 | Howk et al. | 502/217 |
| 3,259.453 | 7/1966 | Stiles | 502/217 X |
| 3,276,186 | 10/1966 | Hronas et al. | 502/244 X |
| 3,523,966 | 8/1970 | Ottmann et al. | 502/242 X |
| 3,676,369 | 7/1972 | Miale | 502/241 X |
| 3,873,469 | 3/1975 | Foster et al. | 502/241 X |
| 3,993,597 | 11/1976 | Stiles | 502/241 X |
| 4,148,758 | 4/1979 | Eberly, Jr. | 502/217 |

FOREIGN PATENT DOCUMENTS

| | | | |
|---|---|---|---|
| 54-43205 | 4/1979 | Japan | 502/241 |

*Primary Examiner*—William G. Wright

[57] ABSTRACT

A catalyst capable of cracking kerosene under lower pressure and temperature comprising (A) kerosene; (B) metal powder mixture of chromium powder, copper powder, lead powder, zinc powder, nickel powder, manganese powder in an amount of 12 to 13 parts by weight per 100 parts by weight of said kerosene; (C) sulfuric acid in an amount of 15 to 30 parts by weight per 100 parts by weight of said kerosene; (D) inorganic powder mixture of aluminum oxide powder, serpentine powder, alum powder, magnesium oxide powder, limestone powder, slake lime powder, silica powder, and granite powder in an amount of 150 to 170 parts by weight per 100 parts by weight of said kerosene.

5 Claims, No Drawings

CATALYST FOR CRACKING KEROSENE

BACKGROUND OF THE INVENTION

The present invention relates to a catalyst for cracking kerosene, particularly to a catalyst capable of cracking kerosene under a pressure of 30–40 kg/cm$^2$ at a temperature of 80°–120° C.

It is well known that kerosene is used as a fuel for heating and cooking. But when burning kerosene, it usually produces considerable smoke and an unpleasant odor, and the smoke and odor not only reduce the heat efficiency but also pollute the air. So, usually kerosene is cracked to kerosene gas to delete the above-mentioned defect. However, up to the present, the known method for cracking kerosene is performed under a pressure of 75–90 kg/cm$^2$ and a temperature of 1500°–3500° C. Because the process operates at a high temperature and pressure, the cost of the equipment is very expensive; and the process is inherent with danger caused by said high operating temperature and pressure. It is highly desirable to develop a process that can reduce the high operating temperature and pressure.

SUMMARY OF THE INVENTION

It is therefore an object of the present invention to provide a catalyst capable of cracking kerosene to kerosene gas under a pressure of 30–40 kg/cm$^2$ at a temperature of 80°–120° C.

In accordance with the present invention, a catalyst capable of cracking kerosene under low temperature and pressure comprises: (A) kerosene; (B) mixture of chromium powder, copper powder, lead powder, zinc powder, nickel powder, manganese powder in an amount of 12 to 13 parts by weight per 100 parts by weight of said kerosene; (C) sulfuric acid in an amount of 15 to 30 parts by weight per 100 parts by weight of said kerosene; (D) mixture of aluminum oxide powder, serpentine powder, alum powder, magnesium oxide powder, limestone powder, slake lime powder, silica powder, and granite powder in an amount of 150 to 170 parts by weight per 100 parts by weight of said kerosene.

The details of the present invention will be more apparent by illustration of the manufacturing process of the catalyst of the present invention in the following specific example.

DETAILED DESCRIPTION OF THE PREFERRED EXAMPLE

The process for manufacturing the catalyst comprises the following steps: introducing 10 kgs of kerosene into a closed tank which is provided with circulating and heating means; heating the kerosene to 100° C. under normal atmosphere; reducing temperature to 80° C. and raising pressure to 10 kg/cm$^2$; introducing 1.5 kgs of aluminum oxide powder into the tank and mixing them by circulation for 2 hours; raising the temperature to 90° C. under the same pressure; introducing 2.0 kgs of serpentine powder into the tank and mixing for 3 hours; raising pressure to 15 kg/cm$^2$ concurrently raising the temperature to 100° C.; introducing 2.0 kgs of alum powder and mixing for 1 hour; removing impurities by filtering or precipitation; raising the pressure to 18 kg/cm$^2$; introducing 1.0 kgs of magnesium oxide and mixing for 1 hour; reducing the pressure to normal atmosphere and reducing the temperature to 50° C.; introducing 16 kgs of a 20% wt lime stone solution into the tank, the solution is made by adding 3.2 kgs of lime stone into water; introducing 2.0 kgs of sulfuric acid, 1.6 kgs of granite powder, 0.03 kgs of chrome powder, 0.12 kgs of silica powder, 0.20 kgs of copper powder, 0.30 kgs of lead powder, 0.15 kgs of zinc powder, 0.50 kgs of nickle powder, 0.10 kgs of manganese powder into the tank in sequence under normal pressure and 50° C. and mixing for 1 hour after every component has been added; raising the pressure to 30 kg/cm$^2$ and concurrently raising the temperature to 100° C.; introducing 5 kgs of slake lime powder into the tank and mixing for 2 hours; reducing the pressure to normal pressure and reducing the temperature to room temperature; removing a resultant mixture from the tank. The obtained mixture is a paste-like substance. The catalyst of the present invention is directly added into the kerosene to be catalyzed and the amount of catalyst produced by the above process is usually about 8 kgs of catalyst per 100 kgs of kerosene employed. While preferred example has been described, it should be understood that this is merely the example for the purpose of clearifying the present invention. The scope of the present invention is intended only to be limited by the appended claims.

What I claim is:

1. A catalyst capable of cracking kerosene under low temperature and pressure comprising: (A) kerosene; (B) metal powder mixture of chromium powder, copper powder, lead powder, zinc powder, nickel powder, manganese powder in an amount of 12 to 13 parts by weight per 100 parts of weight of said kerosene; (C) sulfuric acid in an amount of 15 to 30 parts by weight per 100 parts by weight of said kerosene; (D) inorganic powder mixture of aluminum oxide powder, serpentine powder, alum powder, magnesium oxide powder, limestone powder, slake lime powder, silica powder, and granite powder in an amount of 150 to 170 parts by weight per 100 parts by weight of said kerosene.

2. A catalyst as claimed in claim 1, wherein said metal powder mixture is in an amount of 12.8 parts by weight per 100 parts by weight of said kerosene.

3. A catalyst as claimed in claimed in claim 1, wherein said sulfuric acid is in amount of 20 parts by weight per 100 parts by weight of said kerosene.

4. A catalyst as claimed in claim 1, wherein said inorganic powder mixture is in an amount of 164.2 parts by weight per 100 parts by weight of said kerosene.

5. A process for manufacturing catalyst capable of cracking kerosene under low temperature and pressure comprises the following steps: introducing kerosene into a closed tank which is provided with circulating and heating means; heating the kerosene to 100° C. under normal atmosphere; reducing temperature to 80° C. and raising pressure to 10 kg/cm$^2$; introducing aluminum oxide powder into the tank and mixing them by circulation for 2 hours; raising the temperature to 90° C. under the same pressure; introducing the serpentine powder into the tank and mixing for 3 hours; raising pressure to 15 kg/cm$^2$ concurrently raising temperature to 100° C.; introducing alum powder and mixing for 1 hour; removing impurities by filtering or precipitation; raising the pressure to 18 kg/cm$^2$; introducing magnesium oxide and mixing for 1 hour; reducing the pressure to normal atmosphere and reducing the temperature to 50° C.; introducing a 20%wt lime stone solution into the tank, introducing sulfuric acid, granite powder, chrome powder, silica powder, copper powder, lead powder, zinc powder, nickle powder, manganese powder into the tank in sequence under normal pressure and 50° C. and mixing for 1 hour after every component has been added; raising the pressure to 30 kg/cm and concurrently raising the temperature to 100° C.; introducing slake lime powder into the tank and mixing for 2 hours; reducing the pressure to normal pressure and reducing the temperature to room temperature; removing the resultant mixture from the tank.

* * * * *